United States Patent [19]

MacDonald

[11] 4,124,450

[45] * Nov. 7, 1978

[54] METHOD FOR PRODUCING COKE

[75] Inventor: James E. MacDonald, Latrobe, Pa.

[73] Assignee: Pennsylvania Coke Technology, Inc., Greensburg, Pa.

[ * ] Notice: The portion of the term of this patent subsequent to May 24, 1994, has been disclaimed.

[21] Appl. No.: 788,284

[22] Filed: Apr. 18, 1977

Related U.S. Application Data

[63] Continuation-in-part of Ser. No. 634,602, Nov. 24, 1975, Pat. No. 4,045,299.

[51] Int. Cl.[2] ..... C10B 9/00

[52] U.S. Cl. ..... 201/15; 201/27; 202/93

[58] Field of Search ..... 201/13, 14, 15, 27; 202/92, 93, 101, 102, 113, 114, 211, 212; 110/8 A; 23/277 C

[56] References Cited

U.S. PATENT DOCUMENTS

| | | | |
|---|---|---|---|
| 500,684 | 7/1893 | Westermann | 202/101 |
| 537,872 | 4/1895 | Vannier | 202/101 X |
| 773,809 | 11/1904 | Ramsay | 202/211 X |
| 1,269,895 | 6/1918 | Willinger | 202/101 |
| 3,215,501 | 11/1965 | Phillips | 23/277 C |
| 3,462,346 | 8/1969 | Kernan | 201/27 X |
| 3,763,012 | 10/1973 | Kelley | 202/212 X |
| 3,912,597 | 10/1975 | MacDonald et al. | 201/15 X |
| 4,045,299 | 8/1977 | MacDonald | 202/93 |

*Primary Examiner*—Morris O. Wolk
*Assistant Examiner*—Arnold Turk
*Attorney, Agent, or Firm*—Thomas H. Murray; Clifford A. Poff

[57] ABSTRACT

An increased coking rate of a coal charge in a non-recovery coke oven is achieved without polluting emissions by decreasing the supply of primary air fed into the coke oven chamber throughout the coking period while controlling the amount of heated secondary air for combustion of the effluent in downcomers to maintain the temperature therein between 1200° F and 2400° F and to maintain a temperature in the range of 1800° F to 2700° F in heating flues by further combustion of the effluent discharged thereto from the downcomers. Coking proceeds from the top, bottom and sides of the coal charge. The effluent from the sole heating flue is incinerated within a checker-filled ignition chamber maintained at a temperature of at least 1600° F. The incinerated gases are drawn into a stack at a negative draft pressure of between 0.15 and 0.17 inch water gage.

17 Claims, 5 Drawing Figures

METHOD FOR PRODUCING COKE

CROSS-REFERENCES TO RELATED APPLICATION

This is a continuation-in-part of application Ser. No. 634,602, filed Nov. 24, 1975, now U.S. Pat. No. 4,045,299.

BACKGROUND OF THE INVENTION

This invention relates to the production of coke in a non-recovery type coke oven, and more particularly to a method for operating such a coke oven at an increased coking rate without polluting the atmosphere with effluents including products of distillation liberated from a coal charge during the coking process.

A non-recovery type coke oven is sometimes identified in the art as a beehive coke oven. In the past, a battery of such coke ovens were built adjacent each other and operated by pulling from alternative ovens on alternative days the masses of coke. The heat from the side walls of a hot coke oven and any residual heat retained in a newly-charged coke oven is usually sufficient to ignite the coal in the newly-charged coke oven. The cycle for production of coke by each oven chamber was about 72 hours. A non-recovery type coking process provides important features and advantages to the coking industry, particularly a more economical process for producing coke. The coke ovens used in a non-recovery type coking process are less costly and require a minimum of ancillary equipment, particularly because facilities are not required for treating by-products of the coking process. Non-recovery, beehive-type coke ovens in the past were capable of providing only a relatively low coke output per oven chamber. However, smoke together with other unburnt volatile products escape during the coking process into the atmosphere. The emissions are a source of environmental pollution whereby non-recovery type coking processes have been largely done away with in view of current environmental standards.

The chief method for producing coke currently is by a by-product or retort process wherein air is excluded from the coking chamber and all volatile products liberated during the distillation process are recovered as gas and other coal by-product chemicals. Many coking installations using the retort process still discharge unacceptable quantities of polluting gases into the atmosphere. Usually, the sale of chemicals recovered from the retort process was a source of income, but the sale of such chemicals has become increasingly less profitable.

In my U.S. Pat. No. 4,045,299, entitled "Smokeless Non-Recovery Type Coke Oven", there is disclosed a smokeless non-recovery type coke oven wherein the distillation gases liberated during the coking process are conducted from the space above the coal charge downwardly along passageways in the side walls forming the oven chamber into a sole heating flue. Primary air is fed into the oven chamber to maintain combustion within the space above the coal charge. Secondary air is fed into the downcomers to facilitate combustion of the gases in the sole heating flues and in a tandem arrangement of ignition chambers located downstream therefrom. Additional quantities of secondary air for combustion were injected into the ignition chambers and a burner is used to maintain a predetermined minimum temperature at all times in the ignition chamber to insure incineration of all smoke gases passing therethrough. The waste gases are conducted from the ignition chambers by a horizontal conduit to a stack. The arrangement of parts forming the coke oven chamber are intended to overcome poor and inefficient secondary combustion of the distillation products in the sole heating flues and the passageways within the walls of the coke oven chamber. The secondary combustion did not incinerate the distillation products but represented only a partial combustion thereof. The temperature within the ignition chambers was maintained at a minimum temperature of, for example, 1400° F. for incinerating all the gases reaching this point before the gases were passed to the stack. The smokeless operation of the coke oven was significantly enhanced to the extent that emissions from the stack were found to be within acceptable standards.

I have now discovered an automatic control for the coking process when carrier out in a smokeless non-recovery type coke oven of the type disclosed in my aforesaid patent application will not only increase the rate at which coke is produced in the oven chamber but also further reduces emissions during the operation of the coke oven.

SUMMARY OF THE INVENTION

It is an object of the present invention to provide a method for producing coke in a non-recovery type coke oven wherein throughout the coking period, a supply of primary air is progressively decreased while at the same time a supply of secondary air fed into downcomers for mixture with an effluent conducted thereby from the space above the coal charge is controlled to maintain a sufficiently high temperature to cause coking to proceed from the side walls as well as from the bottom of the coking chamber due to combustion of the gases passed from the downcomers into a sole heating flue.

It is a further object of the present invention to maintain a negative draft pressure of between 0.15 and 0.17 inch water gage in a stack coupled by an ignition chamber used to incinerate effluent discharged thereto from a sole heating flue in a non-recovery type coke oven.

It is a further object of the present invention to adjustably control in a progressively decreasing manner the amount of secondary air fed into downcomers used to conduct distillate products from the space above a coal charge in a non-recovery type coke oven for combustion of the gases in the downcomers and a sole heating flue as well as an ignition chamber downstream thereof.

It is still another object of the present invention to adjustably control the supply of secondary air after heated to at least 200° F. for delivery into downcomers used to conduct distillates from the space above a coal charge in a non-recovery type coke oven by increasing the quantity of heated secondary air to a maximum value within a lapsed time of about 5% of the total coking period and thereafter progressively decreasing the amount of secondary air fed into the downcomers.

The present invention provides a method for producing coke in a coke oven chamber wherein the steps include charging and leveling a coal charge in the oven chamber, controllably decreasing the supply of primary air fed into the coking chamber throughout a coking period to minimize consumption of the coal charge while essentially maintaining the liberation of heat by the combustion of volatile distillate products to cause coking to proceed from the top of the coal charge downwardly, withdrawing the effluent into a plurality of downcomers within the side walls of the coking chamber from the space above the coal charge in the oven chamber, admixing a controlled amount of heated secondary air for combustion with the effluent in each downcomer to maintain a temperature therein within the range of 1200° F. to 2400° F. to cause coking to proceed from the sides of the coal charge, discharging the effluent from the downcomers into a sole heating flue having flue spaces wherein further combustion of the effluent maintains a sole flue temperature within the range of 1800° F. to 2700° F. to cause coking to proceed from the bottom of the coal charge upwardly, conducting the effluent from the sole heating flue into a checker-filled ignition chamber, maintaining a temperature of between 1600° F. and 2200° F. in the ignition chamber to incinerate the effluent, withdrawing the incinerated gases from the checker-filled ignition chamber under a negative draft pressure, and maintaining the negative pressure draft between 0.15 and 0.17 inch water gage during the coking process.

The aforesaid method of producing coke may, in its preferred form, include the further step of heating atmospheric air to a temperature of at least 200° F. for providing the heated secondary air. The volume of the heated secondary air is preferably controlled in a dependent relation to the volume of volatile distillate products conducted by the downcomers. The volume of heated secondary air supplied to each downcomer is increased to a maximum within the first 5% of the coking cycle. A control valve actuated by a timing cam is suitable for adjusting the volume of heated secondary air which is fed into the downcomers. Moreover, heated secondary air is fed into the checker-filled ignition chamber at a substantially constant rate of supply. The supply of primary air which is progressively decreased throughout the coking cycle is controlled by adjusting the position of a closure member relative to an opening defined in an oven door for the oven chamber. Alternatively, the supply of primary air is controlled by adjusting the location of charging covers in relation to openings in the oven roof to vary the size of an air supply opening therebetween. The supply of primary air may also be controlled by adjusting the size of openings in the charging covers themselves. In the method of operating a coke oven according to the present invention, the burnt gases are delivered to a stack at a temperature in the range of 900° F. to 1000° F.

These features and advantages of the present invention as well as others will be more readily understood when the following description is read in light of the accompanying drawings, in which.

Figure 1:
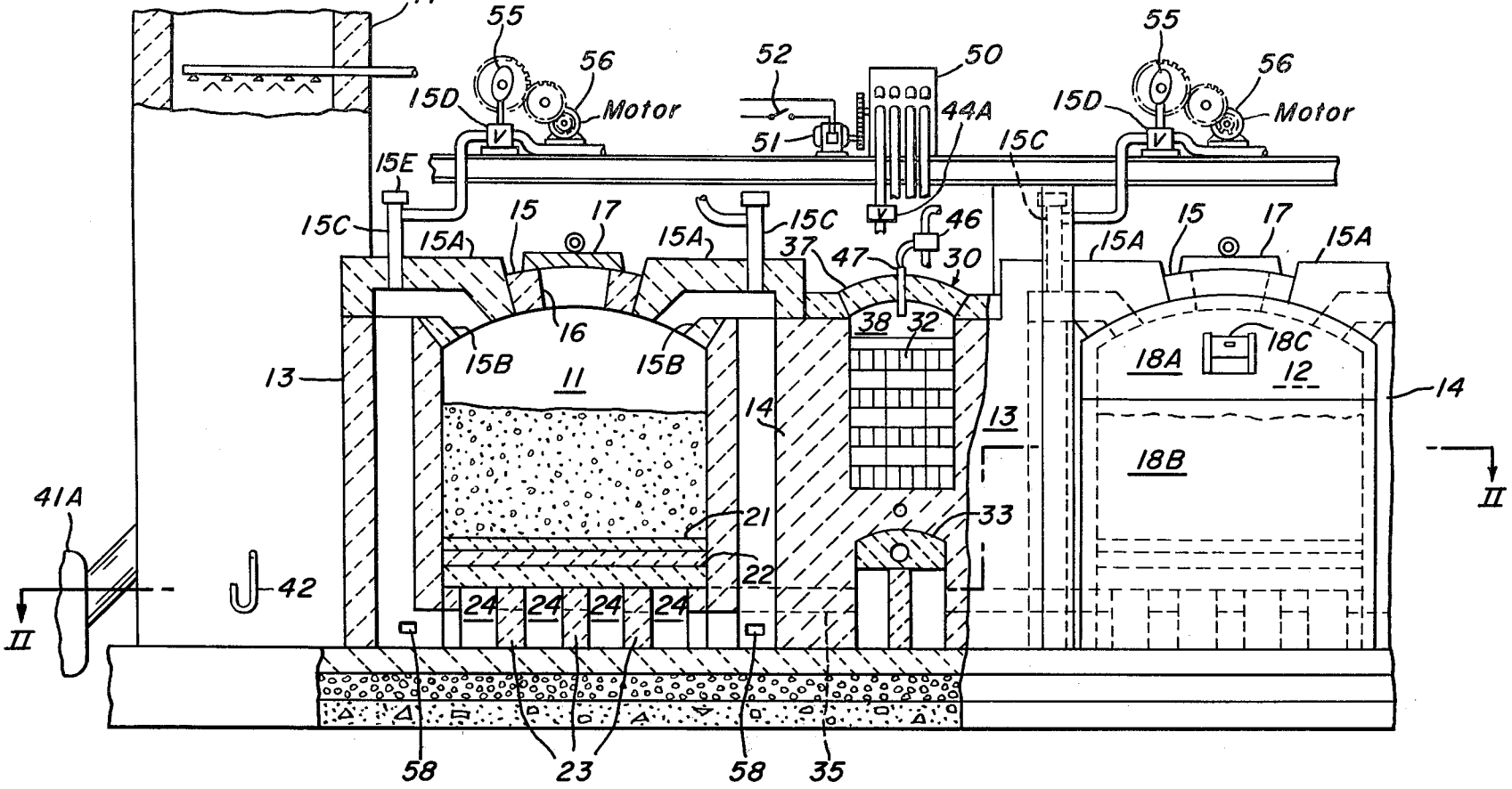
FIG. 1 is an elevational view, partly in section, of a smokeless and non-recovery type coke oven for operation according to the method of the present invention.
Figure 2:
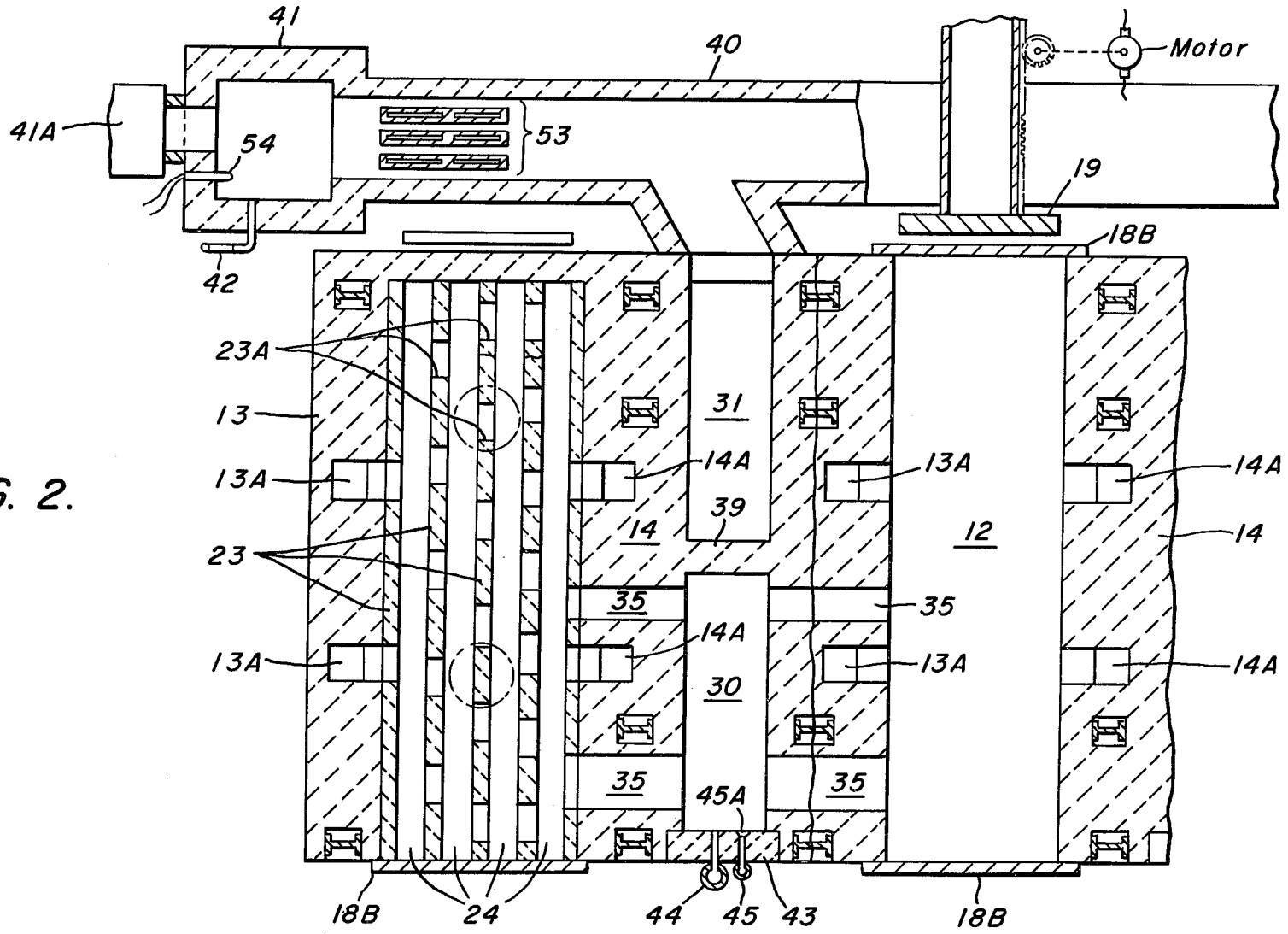
FIG. 2 is a plan view, in section, taken along line II—II of FIG. 1.

FIGS. 1 and 2 illustrate two adjacent coke oven chambers 11 and 12. The structure defining each coke oven chamber includes upstanding side walls 13 and 14 that are made of refractory brick or the like. An arched roof 15 is carried by the top surface of the side walls and spans the distance between them. Two or more trunnel head openings 16 are formed in the oven roof depending upon the length of the oven chamber. Each of these openings is provided with cast iron covers 17 which are removable to charge coal through the opening 16 into the oven chamber. If desired, coal is charged into the oven chambers by a conveyor positioned by a movable support structure to extend through a door opening. In this event, the trunnel openings are not used. The openings 16 are employed, according to one aspect of the present invention, to conduct primary air into each oven chamber. For this purpose, the covers include movable valve plates, not shown, for closing, to a varying extent, an opening in covers 17. However, the position of the covers can also be adjusted relative to openings 16 to vary an opening therebetween to admit primary air into the oven chamber. Upper and lower doors 18A and 18B, respectively, close the opposite ends of the oven chambers. These doors are removable to discharge coke from one end of an oven chamber by a pusher ram 19 supported at the opposite end for movement through the oven chamber. As shown in FIG. 1 in regard to coke oven chamber 12, the upper door 18A includes a slide plate 18C for an opening in the door to adjust the supply of primary air for the coking chamber in addition to or in place of using openings 16. Clay or similar material can also be employed to vary the size of a gap between the door and the coking chamber to control the supply of primary air at various times throughout the coking process.

A charge of coal is supported in the oven chamber by a floor 21 that slopes in a downward direction from end-to-end to facilitate removal of the coke. The floor of the oven chamber is preferably made of silicon carbide or other refractory material of high heat conductivity. The floor 21 rests on a bed of silica tile 22 that is, in turn, supported by spaced-apart columns 23 that are arranged parallel to the side walls 13 and 14 to form flue spaces 24 between the columns. Flue spaces 24 are interconnected by a staggered arrangement of openings 23A in the columns. The flues 24 define sole flues used to provide a residence time for combustion and for extracting residual heat from partially-burned distillation products that are drawn from the space above the coal charge in the coke oven chambers and flow through downcomers 13A and 14A. These downcomers are passageways formed in side walls 13 and 14, respectively. FIG. 2 illustrates two such downcomers in each of the side walls 13 and 14.

Part of the oven roof is made of sections 15A by using cast refractory material. Formed in these sections are passageways 15B that communicate between the space in the oven chamber above the coal charge and the top of the downcomers 13A and 14A. Each passageway 15B is additionally provided with an opening that extends through the top of the roof section 15A where it communicates in a sealed relationship with a vertical pipe 15C. The pipes 15C are employed to introduce heated secondary air for admixture with the partially-burned distillation gases passing downwardly in the downcomers as will be more fully described hereinafter. If desired, the passageways 15B may take the form of openings in the side walls 13 and 14 to conduct distillation gases into the downcomers from the space above the coal charge in the oven chamber.

While the features and advantages of the present invention are useful for a single coke oven chamber, a battery of coke oven chambers may be arranged in a side-by-side relation. The two coking chambers 11 and 12 illustrated in the drawings are intended to represent a portion of such a battery of coke oven chambers. Lying between the coking chambers 11 and 12 are interconnected ignition chambers 30 and 31 that extend in an end-to-end relation between the side walls 14 of chamber 11 and the side walls 13 of chamber 12. The side walls 14 and 13 of the oven chambers 11 and 12, respectively, have an added thickness as compared with the thickness of the remaining side wall for coking chamber 11 which, for the purpose of disclosing the present invention, is assumed to be a first coking chamber in a battery of coke ovens. The ignition chambers 30 and 31 are each provided with a filling of checkerbrick 32. Rider arches 33 span the distance between the side walls 13 and 14. Parallel channels 35 in the side walls 13 and 14 of oven chambers 11 and 12, respectively, interconnect the flues 24 and the ignition chamber 30. The partially-burned distillation products pass through these channels in a generally horizontal direction and enter at the bottom of the ignition chamber 30 to pass in an upward direction through the open spaces in the checkerbricks. Thus, ignition chamber 30 may be referred to as an up-pass chamber and ignition chamber 31 referred to as a down-pass chamber.

Under the preferred operating conditions, the checkerbrick 32 will store heat to maintain an elevated temperature in the ignition chambers. It is not possible to continuously maintain an operating temperature of, for example, 1600° F. due to varying conditions, such as a charge of off-grade coal and interruptions for maintenance and other repair operations. These conditions affect the supply as well as the temperature of the distillation gases passing into the ignition chambers. The temperature in the ignition chambers should not fall below 1400° F., preferably 1600° F., to insure incineration of the partially-burned distillation products and smokeless operation of the coke ovens whereby the emissions from the stack are essentially only waves of heat.

In the ignition chambers, the arched roof 37 forms gas flow spaces 38 above the checkerbrick. Such a roof is preferably of the type known as a "bung" roof which includes refractory brick fitted into a cast iron frame so that the roof can be removed for cleaning and replacing of the checkerbricks. A wall 39 separates the two ignition chambers. The gases pass over the upper edge of this wall from chamber 30 to chamber 31. It is essential that the partially-burned distillation products which enter into the ignition chambers are completely burned therein, i.e., incinerated, so that products of combustion are drawn off from the bottom of the down-pass ignition chamber 31 through a conduit 40 having a refractory lining and extending along the back of the battery of coke ovens. The gases conducted by conduit 40 are delivered to a stack 41 at the base thereof. Means, such as a fan 41A, is used to control the flow of gases within the stack by supplying additional quantities of air in the stack and thereby control draft on the coking chambers. The draft controls the flow of gases in the downcomers, sole heating flues and ignition chambers. According to the present invention, a draft gage 42 is extended through the wall of the stack at the base. The draft gage is used to maintain a critical important negative stack pressure within the range of 0.15 to 0.17 inch water gage.

The outer end of ignition chamber 30 is enclosed by an end wall 43 which has two openings communicating with the gas flow space between the checkerbricks in the ignition chambers. One of these openings receives the end of a vertically-extending pipe 44 which has a flow control valve 44A to adjustably preselect a constant volume of heated air which is introduced by pipe 44 into the ignition chamber 30. The admixing of secondary air with the partially-burned distillation gases is controlled by a valve to assure incineration of the gases within the ignition chambers. The second opening in wall 43 communicates with a vertically-extending fuel supply pipe 45. A high temperature burner 45A is provided on the inner face of wall 43 which receives a controlled supply of fuel, e.g., oil or natural gas. For this purpose, a controller 46 operates in response to a signal from a thermocouple 47 projecting from the lower surface of roof 37 in a manner to detect the temperature within the ignition chambers. The controller 46, through the use of a signal from thermocouple 47, delivers fuel through pipe 45 to the burner when the temperature in the ignition chamber drops below a predetermined minimum temperature of 1600° F. or some other predetermined minimum temperature, required to incinerate any unburned distillation gases reaching the ignition chambers. Reference numeral 58 identifies clean-out ports for solid residue that accumulates at the bottom of downcomers 13A and 14A.

As previously described, heated secondary air is conducted by pipes 15C and 44 for admixing with the partially-burned distillation gases. Each pipe 15C includes a valve 15D to control the flow rate of air within an associated pipe 15C. A supply of heated secondary air is provided by a blower 50 which is driven by a motor 51 that is energized by a switch 52. The blower 50 feeds air into a refractory recuperator 53 which is well known per se in the art and arranged within the conduit 40. As illustrated in FIG. 2, the recuperator 53 is located between the last coking chamber and the stack. By employing the recuperator, the temperature of the gases fed into the stack can be reduced by several hundred degrees. A thermocouple 54 extends into the stack at the base thereof to provide means for measuring the temperature of the gases. At this point in the stack, the gases have a relative constant temperature in the range of 900° F. to 1000° F. The sensible heat recovered by the recuperator provides a heated secondary air supply which is fed by pipes 15C and 44 into the downcomers and ignition chambers, respectively, at a temperature of at least 200° F.

Figure 3:
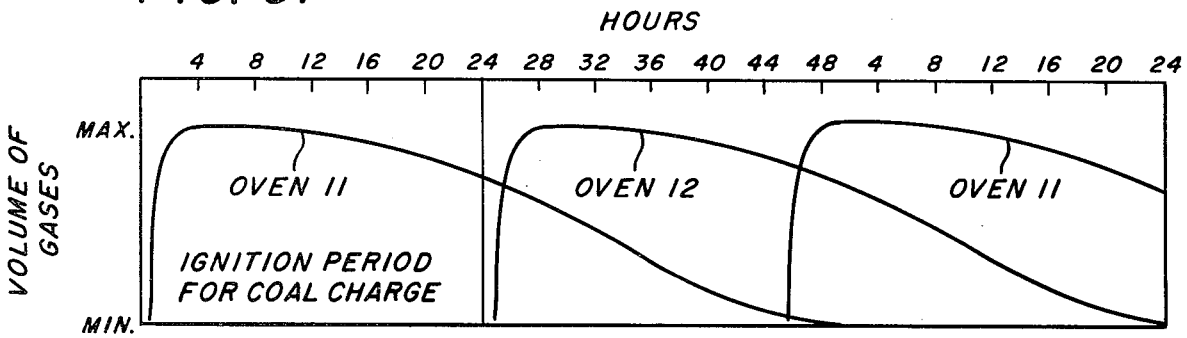
FIG. 3 is a graph illustrating the relative volumes of distillate gases liberated by two coke oven chambers throughout time-displaced coking cycles.
Figure 4:
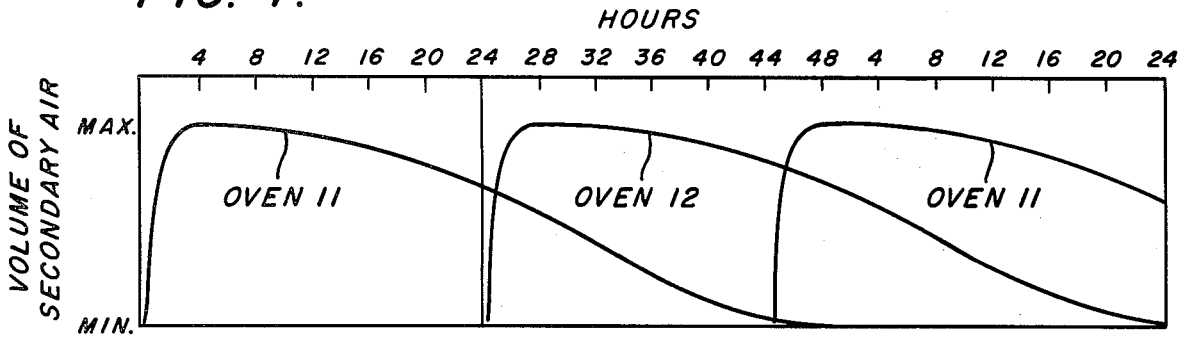
FIG. 4 is a graph illustrating the volume of heated secondary air introduced into downcomers of the non-recovery coke oven chambers throughout the time-displaced coking cycle of two oven chambers.

As shown in FIG. 1, the supply of heated secondary air to each downcomer is controlled by a valve 15D. The valve has a valve stem contacting the surface of a cam 55 supported by a shaft for rotation by a motor 56. The motor shaft is coupled by a speed-reducing gear train with the shaft of the cam. In this way, the cam is driven to rotate at a speed corresponding to one revolution for each coking period which, for the purpose of disclosing the present invention, will be assumed at 24 hours. The profile of the cam 55 is selected to actuate the valve for delivering heated secondary air into the downcomers in volumes, typically represented by the graph of FIG. 4. This graph, based on a 24-hour coking period for coking chamber 11, indicates that after an initial period of about the first 4 hours or 5% of the total coking period, the amount of secondary air fed into the downcomers is increased to a maximum. Thereafter, the volume of heated secondary air is slowly decreased during the next 10 to 12 hours and decreased at a greater rate to a minimum volume at the end of the 24-hour coking period. The graph of FIG. 4 also includes a graph line indicating the same control of heated secondary air for the downcomers of coke oven chamber 12 but at a time-phase relation displaced by 24 hours. As described previously, the volume of heated secondary air which is fed into the ignition chambers by pipe 44 remains constant. It is critically important to control the supply of heated secondary air into the downcomers because an excessive air supply cools the oven masonry and decreases the draft on the oven chamber which is necessary to maintain the flow of gases. On the other hand, an insufficient supply of heated secondary air extends the required coking period because less heat is generated by reduced combustion which leads to a source of pollution. The volume of heated secondary air supplied to each downcomer for a given oven chamber is usually different and unique with the location of the downcomer relative to the location of the primary air supply. The supply of heated secondary air corresponds somewhat to the volume of distillation gases liberated in the coke oven chamber which is illustrated typically by FIG. 3. It is important to note that during the initial period of about 1 hour, the amount of distillate gases given off is at a minimum. The volume of heated secondary air fed into the downcomers at this period of time is also at a minimum to avoid excessive cooling of the oven chamber and adverse effects to the ignition period for the coal charge. FIG. 3 also depicts the time-displace occurrence of the relative volume of gases liberated in the two oven chambers 11 and 12. A relatively large volume of the gases is liberated during the first 24 hours and thereafter the volume of gases is reduced to the point where at the final 2 hours, only relatively small volumes of gases are liberated, but at a relatively high temperature as compared with the gases liberated during the first 24 hours.

In a non-recovery type coke oven of the type hereinbefore described, the overriding consideration is to heat the entire mass of coal charge to a coking temperature without the use of auxiliary fuels. It is critically important to control the supply of primary air fed into the coking chamber throughout the coking period to minimize the consumption of coal. However, sufficient primary air is required to maintain a heat supply by the combustion of volatile distillation products in the space above the coal charge to cause coking to proceed from the top of the coal charge downwardly. It has been found that in a coke oven of the type disclosed herein, that the draft on the oven chamber, when measured at the stack, must be maintained between 0.15 and 0.17 inch water gage. In the event the negative stack pressure is less than this range, then smoke and gases are not carried away and the coking process is disrupted. However, an excessively large negative stack pressure drains excessive amounts of heat from the coking chamber causing the temperature to drop and impairing the coking process. Thus, it is critically important not only to accurately control the primary air supply but also the heated secondary air supply which is fed into the downcomers. A useful control parameter for adjusting the amount of heated secondary air fed into the downcomers is based on maintaining the temperature in the downcomers within a suitable range whereby additional heat is introduced into the coal charge so that coking proceeds from the sides thereof. The temperature in the downcomers is monitored by using suitable well known means, such as thermocouples extending through the walls 13 into the open spaces of the downcomers. A pyrometer is readily useful to measure the temperature in the downcomers through sight openings such as conveniently provided by removing a closure cap 15E from the upper end of each pipe 15C.

Figure 5:
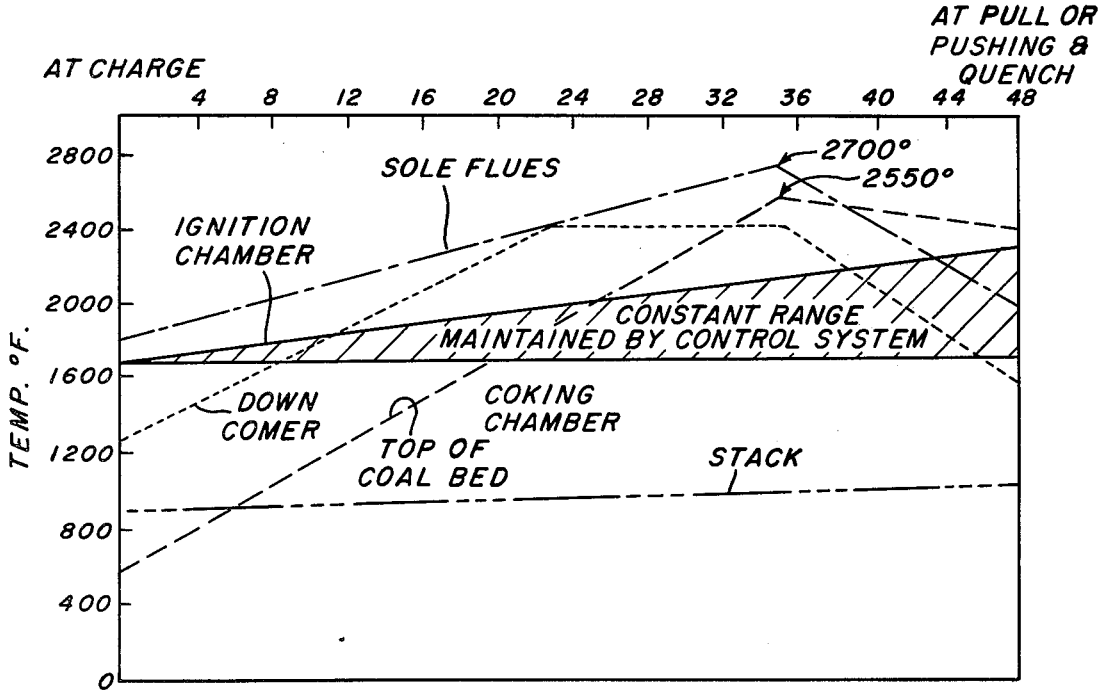
FIG. 5 is a composite graph illustrating the temperatures at various locations in a coke oven throughout a coking period.

FIG. 5 illustrates the useful temperature ranges for the coking process of the present invention. The graph lines are based on a 48-hour coking period for a coal charge that is 42 inches deep. Approximately the same temperature ranges will exist over a compressed period of time of 24 hours when the coal charge is between 22 to 24 inches deep. It can be seen in FIG. 5 that immediately after charging the oven chamber, the temperature in the space above the coal charge increases in a relatively constant manner to 2550° F. after a period of 36 hours and thereafter decreases slightly to about 2400° F. The temperature in the downcomers at charging is about 1200° F. because of stored heat in the oven walls from the previous coking period. The temperature in the downcomers increases due to the combustion therein of the distillation products with heated secondary air. At about 24 hours through the coking period, the temperature in the downcomers reaches a maximum of about 2400° F. which remains constant until about the 36th hour in the coking process, and thereafter drops to about 1500° F. It will be remembered, as illustrated in FIG. 3, that the volume of distillate gases given off during the first 24-hour period is at a maximum, however the temperature in the downcomers does not reach a maximum until about the end of the first 24-hour period. The temperature in the sole heating flues increases from about 1800° F. at charging to about 2700° F. after about 36 hours in the coking period. Thereafter, the temperature drops in the sole heating flues, principally due to lower volumes of distillate gases to about 2000° F. The heat from the sole heating flues, of course, causes coking to proceed upwardly from the bottom of the coal charge. As previously described, the ignition chambers must be maintained at a predetermined minimum temperature throughout the coking cycle by each oven chamber. In the preferred form of the present invention, the control system for the oil burner is set to maintain a minimum temperature of 1600° F. in the ignition chambers. Because the distillation products given off during the first few hours in the coking cycle are high, incineration does not occur because of insufficient heat and air. The burner may be required to correctly maintain the minimum temperature in the ignition chamber. However, thereafter the temperature in the ignition chambers increases to a maximum of about 2300° F. at the end of the coking cycle. The temperature range of 1600° F. to 2300° F. is maintained in the ignition chambers. All unburned distillation gases are incinerated within the ignition chambers. The gases passed from the downpass ignition chamber are conducted by the horizontal conduit beyond the recuperator to the stack where they are exhausted as heat waves within a temperature of 900° F. to 1000° F.

In a coking process according to the present invention, a substantial amount of preheated secondary air is introduced into the individual downcomers to secure a good bright flame. As coking proceeds and the quantity of gases and volatiles liberated by the coal charge begin to diminish, the amount of heated secondary air introduced into the downcomers is reduced. Near the end of the coking process, only relatively small amounts of heated secondary air are required in the downcomers. The control of the coking process in several coking chambers has increased importance because a common ignition chamber system is coupled to the coke oven chambers by way of the sole heating flues to receive the effluent at varying temperatures depending upon the lapsed time through the various coking cycles.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method for producing coke in a non-recovery type coke oven chamber including side walls and a floor comprising the steps of:

charging and leveling a coal charge in the oven chamber leaving a space about the coal charge, controllably decreasing a supply of primary air fed into the coking chamber throughout a coking period to minimize consumption of the coal charge while essentially maintaining the liberation of heat by the combustion of volatile distillate products to cause coking to proceed from the top of the coal charge downwardly, withdrawing the effluent into a plurality of downcomers within the side walls of the coking chamber from the space above the coal charge in the coking chamber, admixing a controlled amount of heated secondary air for combustion of the effluent in each downcomer to maintain a temperature therein within the range of 1200° F. to 2400° F. to cause coking to proceed from the sides of the coal charge, discharging the effluent from the downcomers into a sole heating flue beneath the floor of the coking chamber having flue spaces wherein further combustion of the effluent maintains a sole flue temperature within the range of 1800° F. to 2700° F. to cause coking to proceed from the bottom of the coal charge upwardly, conducting the effluent from the sole heating flue into a checker-filled ignition chamber, maintaining a temperature of between 1600° F. and 2200° F. in the ignition chamber to incinerate the effluent, withdrawing the incinerated gases from the checker-filled ignition chamber under a negative draft pressure, and maintaining said negative draft pressure between 0.15 and 0.17 inch water gage during the coking process.

2. The method according to claim 1 including the further step of heating atmospheric air to a temperature of at least 200° F. for providing said heated secondary air.

3. The method according to claim 1 including the further step of feeding air for combustion into said checker-filled ignition chamber at a substantially constant rate of supply.

4. The method according to claim 1 wherein said step of controllably decreasing the supply of primary air includes adjusting the position of a closure member for a primary air supply opening defined in an oven door for said oven chamber.

5. The method according to claim 1 wherein said step of controllably decreasing the supply of primary air includes an opening in the roof for the oven chamber by adjusting the location of charging covers.

6. The method according to claim 1 wherein said step of controllably decreasing the supply of primary air includes controlling the size of openings in charging covers supported by the roof for the oven chamber.

7. The method according to claim 1 wherein said withdrawing incinerated gases includes conducting the gases into the base of a stack at a temperature within the range of 900° F. to 1000° F.

8. The method according to claim 1 wherein said admixing a controlled amount of heated secondary air includes adjusting the volume of heated secondary air in a dependent relation to the volume of volatile distillate products conducted by said downcomers.

9. The method according to claim 8 wherein the volume of heated secondary air supplied into each downcomer is increased to a maximum within the first 5% of the coking cycle.

10. The method according to claim 8 wherein said step of adjusting the volume of heated secondary air includes adjusting a control valve by a timing cam through rotation thereof in a timed relation to the coking cycle.

11. A method for producing coke in a battery of non-recovery type coke oven chambers each including side walls and a floor comprising the steps of:

charging and leveling a coal charge within a given coke oven chamber leaving a space above the coal charge, the newly-charged coke oven chamber being adjacent a coke oven chamber wherein the coking process has proceeded to a point where distillation gases are liberated, controllably decreasing a supply of primary air fed into each coking chamber throughout the coking period thereby to minimize consumption of the coal charge while essentially maintaining the liberation of heat by the combustion of effluent including volatile distillate products to cause coking to proceed from the top of the coal charge downwardly, withdrawing the effluent into a plurality of downcomers within the side walls of each coking chamber from the space above the coal charge in the coking chamber, admixing heated secondary air in a dependent relation to the volume of effluent liberated from the individual coal charges in the coke oven chamber for combustion of the effluent in the downcomers of the individual coke oven chambers to maintain a temperature therein within the range of 1200° F. to 2700° F. to cause coking to proceed from the sides of the coal charges in the coke oven chambers, discharging the effluent from the downcomers of each coke oven chamber into a sole heating flue beneath the floor of the coking chamber having flue spaces wherein further combustion of the effluent maintains a sole flue temperature within the range of 1800° F. to 2700° F. to cause coking to proceed from the bottom of the coal charge upwardly, conducting the effluent from the sole heating flues of two coke oven chambers into one system of a plurality of checker-filled ignition chambers spaced along the coke oven battery, maintaining a temperature of between 1600° F. and 2200° F. in the ignition chambers to incinerate the effluent, withdrawing the incinerated gases from each system of checker-filled ignition chambers under a negative draft pressure, and maintaining said negative draft pressure between 0.15 and 0.17 inch water gage during the coking process by each coke oven chamber.

12. The method according to claim 11 including the further step of heating atmospheric air to a temperature of at least 200° F. for providing said heated secondary air.

13. The method according to claim 11 including the further step of feeding air at a substantially constant rate of supply for combustion into said system of checker-filled ignition chambers.

14. The method according to claim 11 wherein said step of controllably decreasing the supply of primary air includes adjusting the position of a closure member for a primary air supply opening defined in an oven door of each coke oven chamber.

15. The method according to claim 11 wherein said withdrawing incinerated gases includes conducting the gases into the base of a stack at a temperature within the range of 900° F. to 1000° F.

16. The method according to claim 11 wherein the volume of heated secondary air supplied into each downcomer in the side walls of a given coke oven chamber is increased to a maximum within the first 5% of the coking cycle.

17. The method according to claim 16 wherein the volume of heated secondary air is adjusted by a control valve by a timing cam through rotation thereof in a timed relation to the coking cycle for each coke oven chamber.

* * * * *